US008235063B2

(12) United States Patent
Estrada, Jr.

(10) Patent No.: US 8,235,063 B2
(45) Date of Patent: Aug. 7, 2012

(54) MULTI-STAGE COLLAPSIBLE CRUTCH

(76) Inventor: Hector Mark Estrada, Jr., Austin, TX (US)

( * ) Notice: Subject to any disclaimer, the term of this patent is extended or adjusted under 35 U.S.C. 154(b) by 157 days.

(21) Appl. No.: 11/766,778

(22) Filed: Jun. 21, 2007

(65) Prior Publication Data

US 2008/0314426 A1 Dec. 25, 2008

(51) Int. Cl.
*A45B 9/04* (2006.01)
*A61H 3/02* (2006.01)

(52) U.S. Cl. ..... 135/75; 135/69; 135/82

(58) Field of Classification Search ..... 135/68, 135/69, 72, 73, 74, 75, 82
See application file for complete search history.

(56) References Cited

U.S. PATENT DOCUMENTS 1,262,153 A * 4/1918 Wolf ..... 135/69
1,761,502 A * 6/1930 Sullivan ..... 135/82
2,554,653 A * 5/1951 Wisecarver ..... 135/68
3,205,905 A * 9/1965 Gottman ..... 135/69
4,637,414 A * 1/1987 Urban ..... 135/73
6,286,529 B1 * 9/2001 Olivera ..... 135/82
2002/0020438 A1 * 2/2002 Best ..... 135/69

* cited by examiner

*Primary Examiner* — David Dunn
*Assistant Examiner* — Danielle Jackson
(74) *Attorney, Agent, or Firm* — Gregory K Goshorn; Greg Goshorn, P.C.

(57) ABSTRACT

Provided is a crutch that may be collapsed for storage and shipment, adjustable for different users and mitigates the affect of the enrich striking the ground. A saddle support surface is coupled to two rails that extend and slide through a handrail and a wishbone. The rails may be secured with respect to the handrail and wishbone in a variety of positions, enabling the distance between the support surface and the handgrip and the length of the crutch to be adjusted. In addition, the rails may be positioned in the handrail and wishbone such that the support surface fits against the handrail and the handrail against the wishbone. A shock tube extends from and slides through the wishbone and may be secured in a variety of positions to adjust the length of the crutch to account for different users and to minimize the length for storage and shipment.

17 Claims, 8 Drawing Sheets

MULTI-STAGE COLLAPSIBLE CRUTCH

TECHNICAL FIELD

The present invention relates generally to an orthopedic device and, more specifically, to multi-stage collapsible crutch.

BACKGROUND OF THE INVENTION

A crutch is an orthopedic device that supports a person's weight to facilitate walking when the person has injured a leg or ankle. Typically, a crutch is constructed of one or more pieces of wood or metal, is a fixed length, includes a concave surface upon which the user places their underarm for support and is a fixed size with respect to the length and the distance between the concave, support surface and a handle where the user's hand grips the crutch. One issue that arises with respect to this typical type of crutch is that, although the crutch is a fixed length, people come in a variety of heights and proportions, in other words, crutches of multiple sizes and proportions must be manufactured and individually fitted to specific users both to address differences in height and leg and arm length among users. A second issue is that, as a person walks with a crutch, the force of the crutch striking the ground is transferred to the underarm of the user. The repeated shock associated with the end of the crutch striking the ground may aggravate an existing injury or even cause a new injury.

One device that addresses some of these concerns is described in U.S. Pat. No. 7,104,271 (the "Larson" patent). Larson is directed to a crutch that telescopes and enables a user to adjust the length of the crutch to account for the distance between the user's underarm and the ground. However, the Larson crutch does not enable user to adjust the distance between the underarm, support surface and the handle where the user grips the crutch.

The current state of the art does not provide a crutch that is adjustable for users of different heights and proportions and mitigates the affect of the crutch striking the ground. In addition, current technology does not provide a crutch that collapses to a short length to facilitate storage and shipment.

SUMMARY OF THE INVENTION

Provided is a crutch that is able to be collapsed for ease of storage and shipment, adjustable for users of different heights and proportions and mitigates the effect of the crutch repeatable striking the ground.

A support surface, or "saddle support," is coupled to two rails that extend and slide through a handgrip and a wishbone structure, or "wishbone." The handgrip enables the user to hold onto the crutch. Both the handgrip and the wishbone may be secured with respect to the rails in a variety of positions, enabling the distance between the support surface and the handgrip to be adjusted to the height and proportions of different users. The secured position of the rails within the wishbone also affects the overall length of the crutch. In addition, the rails may be positioned in the wishbone such that the support surface fits against the wishbone. In this configuration, the crutch is compact and takes up the least possible space to facilitate storage and shipment.

A support, or shock, tube extends and slides through the wishbone. The shock tube extends from the wishbone to the ground and may be secured in a variety of positions, thus enabling the user a second means to adjust the length of the crutch. Like the rails, the shock tube may be positioned such that the overall length of the crutch is minimized for ease of storage and shipment. The shock tube includes one or more shock absorbing devices such as but not limited to springs and a shock-absorbing tip to mitigate the stress caused to the user from the crutch repeatable striking the ground.

This summary is not intended as a comprehensive description of the claimed subject matter but, rather, is intended to provide a brief overview of some of the functionality associated therewith. Other systems, functionality, features and advantages of the invention will be or will become apparent to one with skill in the art upon examination of the following figures and detailed description.

DETAILED DESCRIPTION OF THE FIGURES

DETAILED DESCRIPTION OF THE FIGURES

The following description illustrates the claimed subject matter but, of course, should not be construed as in any way limiting its scope. Those with skill in the medical and orthopedic arts will recognize that the disclosed embodiments have relevance to a variety of orthopedic devices in addition to those described below.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value failing within the range, unless otherwise indicated herein, and each separate value is incorporated into the specification as if it were individually recited herein. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Figure 1:
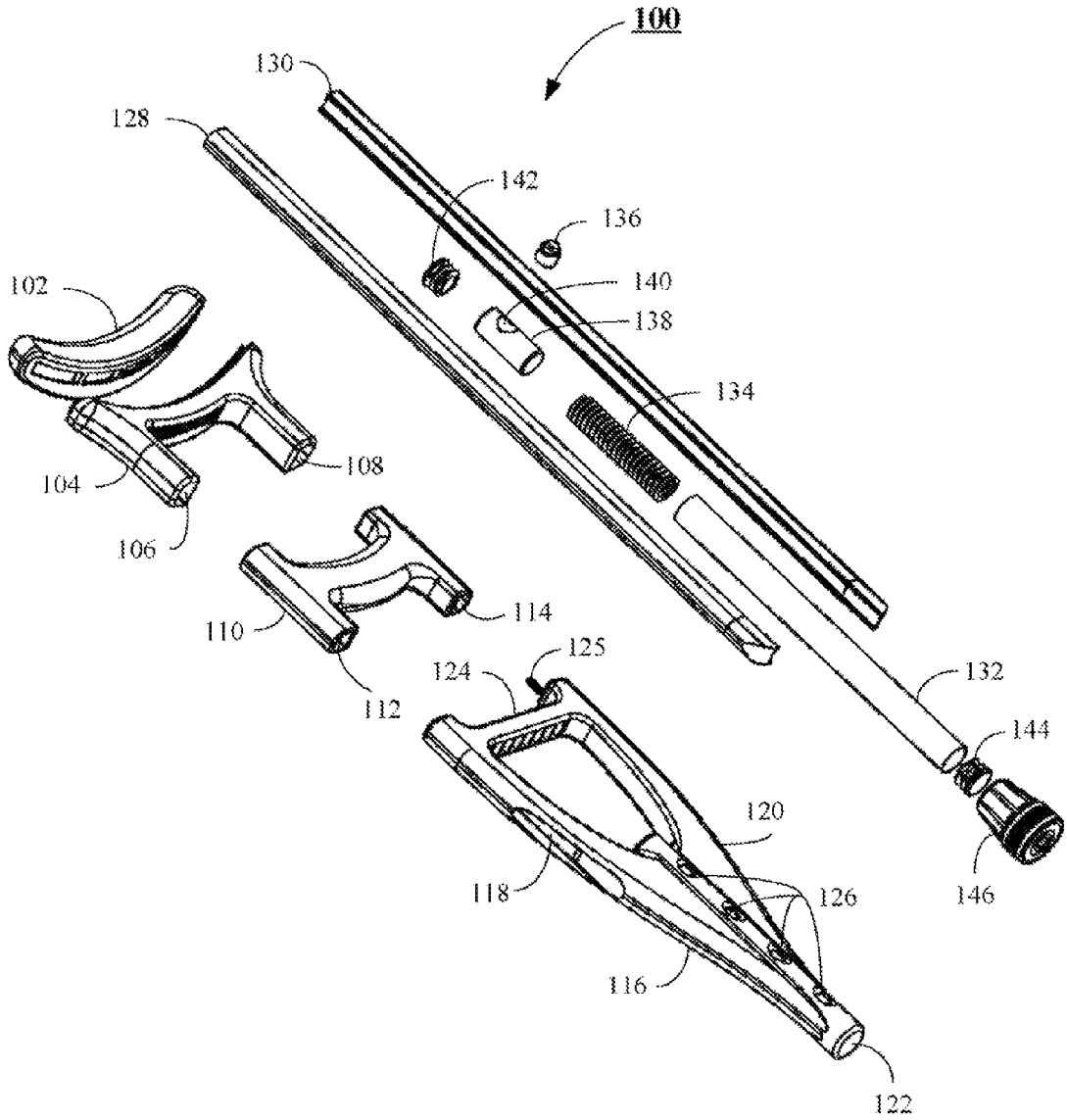
FIG. 1 is an illustration of an exploded, or unassembled, view of the claimed crutch showing the various components.

The following reference numerals are employed throughout the figures. Like numerals in different figures refer to the same object, often from different perspectives. A better understanding of the present invention can be obtained when the following detailed description of the disclosed embodiments is considered in conjunction with the following figures, in which FIG. 1 is an illustration of an exploded, or unassembled, crutch 100 showing various components. Though out the reminder of this description, the claimed device will be referred to as crutch 100, although shown from different perspectives and in both unassembled (FIG. 1) and assembled (FIGS. 2 and 3) configurations.

The components of the claimed subject matter, many of which are shown in FIG. 1, are listed in the following table:

| | |
|---|---|
| 100 | Cnitch |
| 102 | Axillary cushion |
| 104 | Saddle support |
| 106 | First saddle support cavity |
| 108 | Second saddle support cavity |
| 110 | Handgrip |
| 112 | First handgrip channel |
| 114 | Second handgrip channel |
| 116 | Wishbone |
| 118 | First upper wishbone channel |
| 120 | Second upper wishbone channel |
| 122 | lower wishbone channel |
| 124 | Wishbone strut |
| 125 | Handgrip release peg |
| 126 | Shock tube adjustment holes |
| 128 | First rail |
| 130 | Second rail |
| 132 | Shock tube |
| 134 | Spring |
| 136 | Spring adjustment button |
| 138 | Spring compression plug |
| 140 | Spring button hole |
| 142 | First shock tube end cap |
| 144 | Second shock tube end cap |
| 146 | Shock absorbing boot |
| 148 | Spring retention ridge |
| 150 | Shock tube assembly—unassembled |
| 152 | Height markings |
| 154 | Alternative shock tube adjustment hole |
| 160 | Shock tube assembly—assembled |
| 162 | Shock tube adjustment slot |
| 164 | Slide clip |
| 166 | Slide clip button |
| 168 | Slide clip pin |
| 170 | Slid clip pinhole |
| 172 | Second slide pin |

The features, functions and relationships among the components listed in the table directly above are described in more detail below in conjunction with FIGS. 2-8.

Axillary cushion 102 is positioned upon saddle support 104 so that the user's underarm is cushioned when the user's weight rests upon crutch 100 during normal use. Typically, axillary cushion 102 is made of silicone gel, rubber or any other suitable material. In one embodiment, axillary cushion 102 is color-coded to indicate the length of crutch 100. For example, a red axillary cushion 102 indicates that crutch 100 is an appropriate size for a child and a blue axillary cushion 102 indicates that crutch 100 is an appropriate size for an adult. Saddle support 104 is configured to fit comfortable under a user's underarm and includes two (2) cavities, a first saddle support cavity 106 and a second saddle support cavity 108.

A handgrip 110 has two (2) channels, a first handgrip channel 112 and a second handgrip channel 114. A wishbone 116 includes two (2) channels, a first upper wishbone channel 118 and a second upper wishbone channel 120. Although obscured by wishbone 116, second wishbone channel 120 is similar to first wishbone channel 118, each of which forms a passageway through wishbone 116. Wishbone 116 also includes a lower wishbone channel 122 and a wishbone strut 124, which adds strength and stability to wishbone 116. A handgrip release peg 125 extends from wishbone 116 and fits into a corresponding hole (not shown) in handgrip 110 when crutch 100 is in a collapsed configuration. When peg 125 is engaged in the corresponding hole of handgrip 110, a mechanism (not shown) causes handgrip 110 to be unsecured with respect to rails 128 and 130 so that handgrip 110 may slide along rails 128 and 130. In other words, when a user releases wishbone 116 to slide along rails 128 and 130, the action of pushing wishbone 116 against handrail 110 causes handrail 110 to be released also. In this manner, a user does not need to take separate action to release handgrip 110 to place crutch 100 in a collapsed configuration. The mechanism that secures handgrip 110 to rails 128 and 130 is similar to the mechanism that secures wishbone 116 to rails 128 and 130, as described below in conjunction with FIGS. 6-8.

A series of shock tube adjustment holes 126 pass perpendicularly through wishbone 116 into lower wishbone channel 122. Holes 126 are evenly spaced at some predetermined distance. For example, holes 126 may be spaced at intervals of two (2) inches. An additional series of holes (not shown), similar to holes 126, are placed on the opposite side of wishbone 116. The additional series of holes are also placed at the same predefined interval as holes 126 but are staggered with respect to holes 126. Both holes 126 and the alternative holes are employed to secure shock tube 132 to wishbone 116 when button 136 extends through one of the holes. In this manner, if for example holes 126 are two (2) inches apart, the length of crutch 100 may be adjusted in one (1) inch increments by alternating button 136 between holes 126 and one of the additional series of holes.

A first rail 128 and a second rail 130 are long rods with a shape and diameter that enables them to fit snuggly into first saddle support cavity 106 and second saddle support cavity 108, respectively. The shape and diameter of first rail 128 and second rail 130 also enables rails 128 and 130 to fit snuggly and pass relatively freely thorough first handgrip channel 106 and second handgrip channel 108, respectively. In addition, the shape and diameter of first rail 128 and second rail 130 enables rails 128 and 130 to fit snuggly and pass relatively freely thorough first upper wishbone channel 118 and second upper wishbone channel 120, respectively.

The diameter of a support, or shock, tube 132 enables shock tube 132 to fit snuggly and pass relatively freely thorough lower wishbone channel 122. A spring 134 fits into shock tube 132 and, based upon the compression of spring 134 provided by an adjustment of spring compression plug 138, provides a variable shock absorbing capability to crutch 100. An adjustment button 136 fits into a spring button hole 140 in spring compression plug 138 and through a spring tube slide slot 162 (see FIG. 5) in shock tube 132. When shock tube 132 is compressed due to the weight of the user, button 136 slides along slot 162 subject to tension on spring 134. In this manner, spring 134 absorbs the impact of shock tube 132 and thus crutch 100, against the ground. In the alternative, the support tube does not include any mechanism for absorbing impact.

When button 136 is pressed, a user is able to change the position of button 136 between slot 162, which provides the cushion of spring 134, an alternative shock tube adjustment hole 154, which eliminates the cushioning affect of spring 134. When button 136 is released, button extends either through hole 154 or slot 162, thus either securing shock tube 132 in a fixed position with respect to wishbone 116 or providing a compression of spring 134 to cushion an impact, respectively. A first shock tube end cap 142 and a second shock tube end cap 144 close off the ends of shock rube 132 to provide a finished look. A shock tube assembly 150 that incorporates components 132, 134, 136, 138, 142, 144 and 146 is described in more detail below in conjunction with FIGS. 4 and 5.

Figure 2:
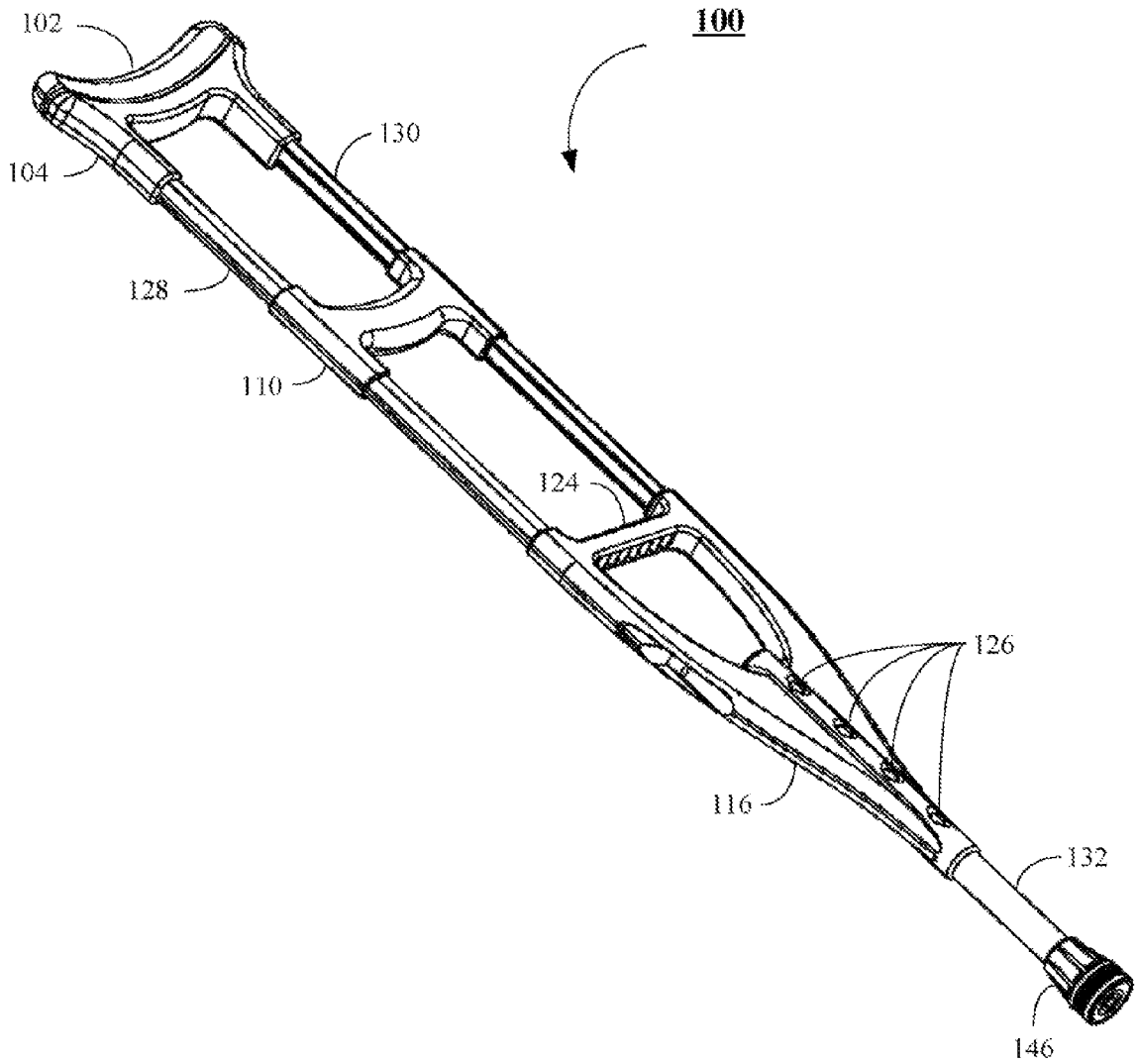
FIG. 2 is an illustration of the crutch of FIG. 1 in an assembled configuration.

FIG. 2 is a second illustration of crutch 100, first introduced above in conjunction with FIG. 1. In FIG. 2, components 102, 104, 110, 112, 116, 128, 130, 132, 134, 136, 138, 142, 144 and 146 (FIG. 1) are fitted together into an expanded, or functional, configuration of crutch 100. In other words, FIG. 2 shows crutch 100 configured as normally used by a person. Some elements shown in FIG. 1, i.e. components 106, 108, 112, 114, 118, 120, 122, 134, 138, 140 and 144, are obscured in FIG. 2, either within or behind other visible components.

First rail 128 is inserted into first saddle support cavity 106 (FIG. 1) and second rail 130 (FIG. 1) is inserted into second saddle support cavity 108. First and second rails 128 and 130 may be threaded, glued, bolted or secured by any suitable means into cavities 106 and 108, respectively, because typically, once inserted rails 128 and 130 are not removed from cavities 106 and 108 during normal use. In the alternative, rails 128 and 130 are secured into cavities 106 and 108 in a manner that enables rails 128 and 130 to be easily removed to facilitate disassembly of crutch 100.

Rails 128 and 130 are inserted through handgrip 110 via first handgrip channel 112 (FIG. 1) and second handgrip channel 114 (FIG. 1), respectively. Once secured into cavities 106 and 108 and inserted through channels 112 and 114, rails 128 and 130 are inserted through first upper wish bone channel 118 (FIG. 1) and second upper wish bone channel 120 (FIG. 1), respectively.

In the expanded configuration illustrated in FIG. 2, wishbone 116 is positioned near the opposite end of rails 128 and 130 from saddle support 104. The length of crutch 100 is adjusted by changing the position of shock tube 132 with respect to wishbone 116. In addition, as explained above, the length of crutch 100 may be adjusted by changing the position of wishbone 116 on rails 128 and 130. A mechanism for the adjustment of wishbone 116 is described in more detail below in conjunction with FIGS. 6 and 7. An adjustment of handgrip 110 is implemented by changing the position of handgrip 110 on rails 128 and 130 using a mechanism similar to that for changing the position of wishbone 116 with respect to rails 128 and 130. In other words, crutch 100 is adjustable to account both for the height of the user and the length of the user's arms.

Figure 3:
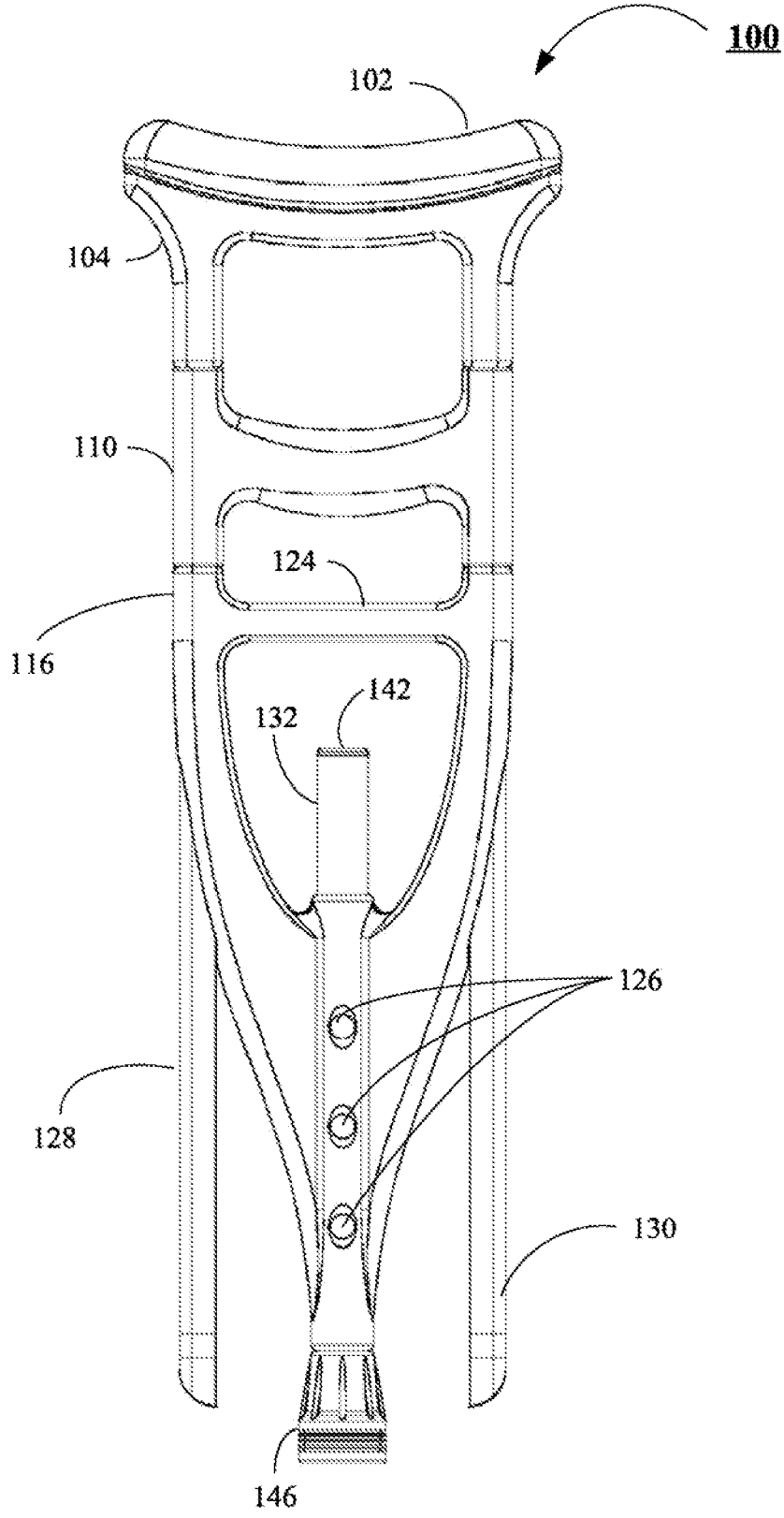
FIG. 3 is an illustration of the crutch of FIGS. 1 and 2 in a collapsed configuration to facilitate storage and shipment.

FIG. 3 is a third illustration of crutch 100, first introduced above in conjunction with FIGS. 1 and 2. In FIG. 3, components 102, 104, 110, 112, 116, 128, 130, 132, 134, 136, 138, 142, 144 and 146 (FIG. 1) are fitted together into a collapsed, or compressed, configuration of crutch 100. In other words, FIG. 3 shows crutch 100 configured to minimize the length of crutch 100, typically to facilitate storage or shipment. Like FIG. 2, some elements shown in FIG. 1, i.e. components 106, 108, 112, 114, 118, 120, 122, 134, 138, 140 and 144, are also obscured in FIG. 3, either within or behind other visible components.

In FIG. 3, handgrip 110 is positioned on rails 128 and 130 so that handgrip 110 abuts saddle support 104 and wishbone 116 is positioned on rails 128 and 130 so that wishbone 116 abuts handgrip 110. In addition, shock tube 132 is positioned in lower wishbone channel 122 such that the end of shock tube 132 affixed to shock absorbing boot 146 is as close to the saddle support 104 end of crutch 100 as possible. In the compressed configuration, crutch 100 is approximately one half as long as the length of crutch 100 configured in the expanded position (FIG. 2).

Figure 4:
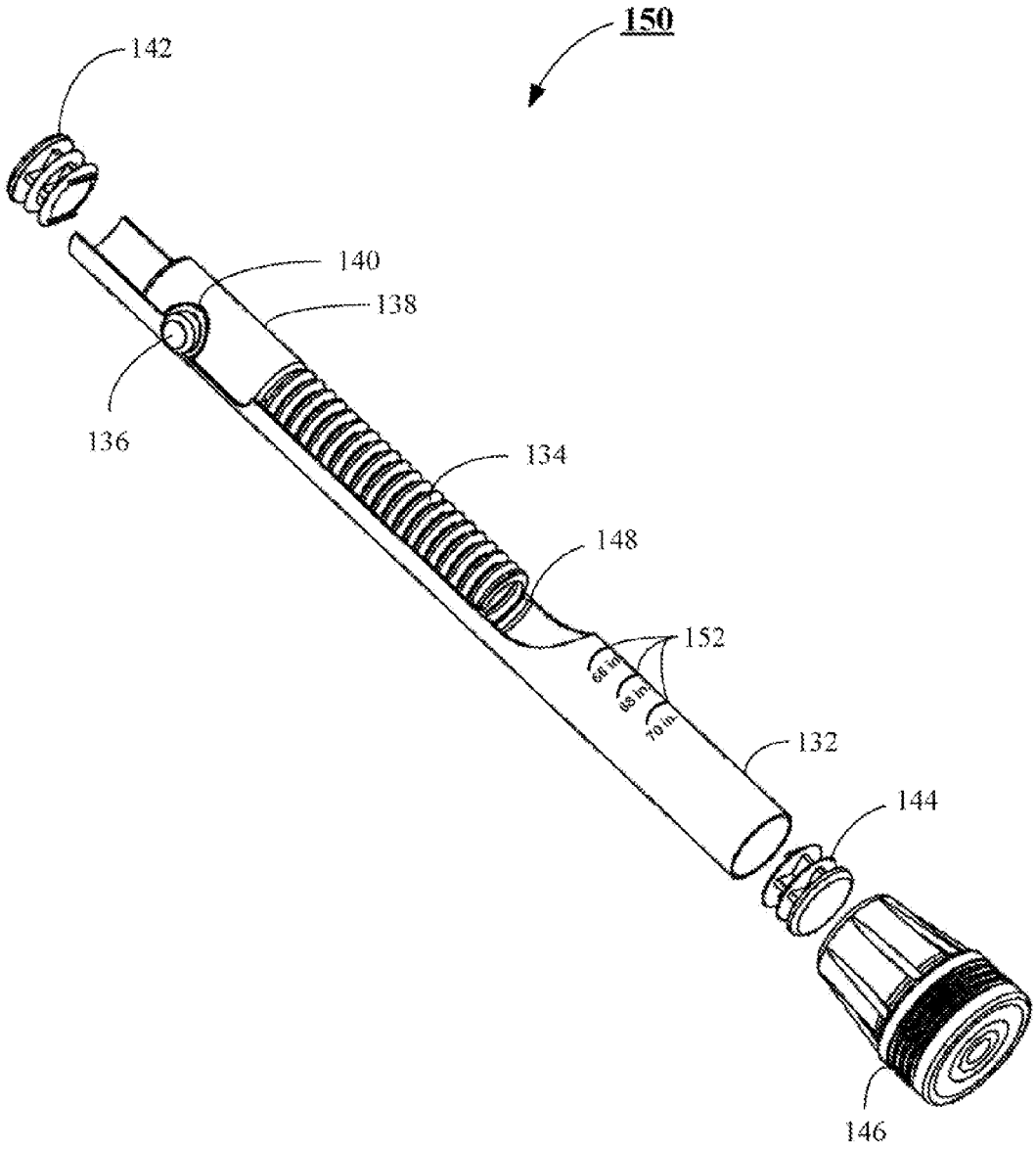
FIG. 4 is an illustration of a cur-away view of an exploded, or partially unassembled, shock tube component of the claimed subject matter.

FIG. 4 is an illustration of a cut-away view of an exploded, or unassembled, shock tube assembly 150, components of which were first introduced above in conjunction with FIG. 1. Shock tube assembly 150 includes shock tube 132, spring 134, adjustment button 136, spring compression plug 138, first shock tube end cap 142, first shock tube end cap 144 and shock absorbing boot 146, all introduced above in conjunction with FIG. 1.

Spring 134 is held in position within shock tube 132 between a ridge 148 in the interior of shock tube 132 and spring compression plug 138. Button 136 fits within spring button hole 140 on a spring (not shown) so that when pressed and released button 136 returns to an appropriate position for securing shock tube assembly 150 with respect to wishbone 116. Markings 152 are employed in conjunction with wishbone 116 to provide a user an indication of the length of crutch 100 when crutch 100 is in the expanded configuration. For example, when shock tube assembly 150 is secured in wishbone 116, i.e. button 136 protrudes through one of holes 126 (FIGS. 1-3), a marking 152 corresponding to the current length of crutch 100 is either visible through an opening (not shown) in wishbone 116 or aligned with some particular point, such as the top or bottom, of wishbone 116.

Figure 5:
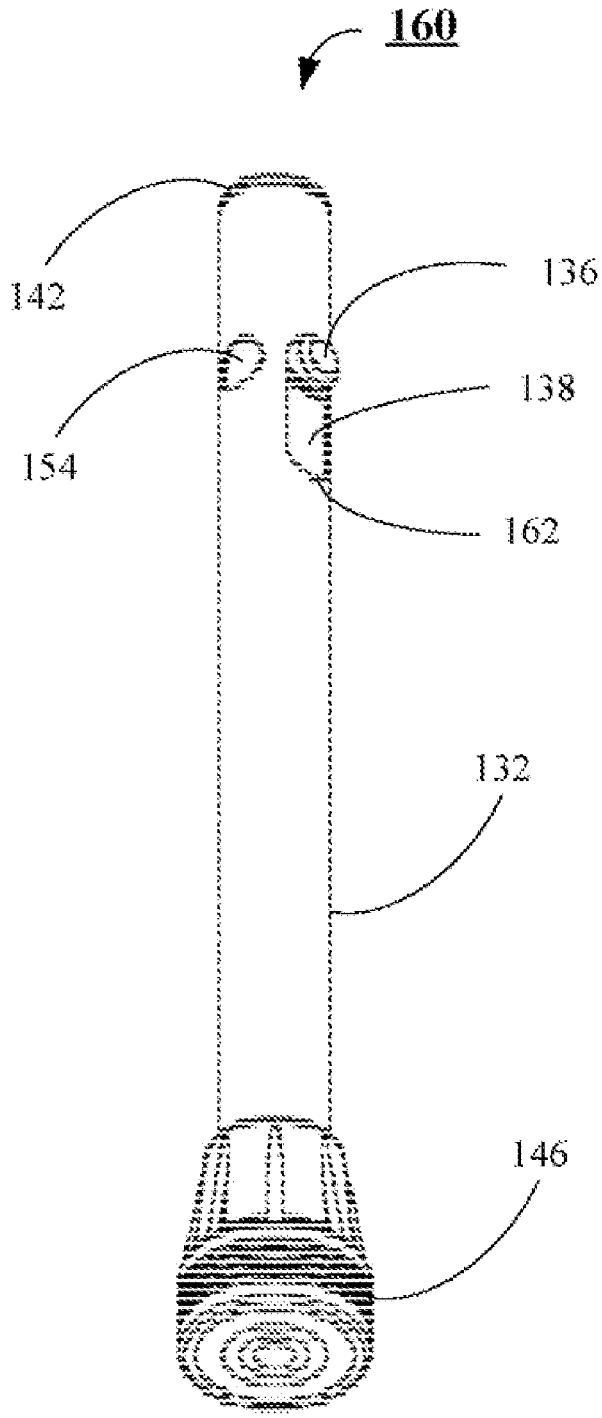
FIG. 5 is an illustration of an assembled shock tube, first introduced in conjunction with FIGS. 1-4.

FIG. 5 is an illustration of an assembled shock tube 160, described above in unassembled form 150 in conjunction with FIG. 4. Visible components of shock tube assembly 160 include shock tube 132, button 136, spring compression plug 138, first shock tube end cap 142, shock absorbing boot 146, shock tube adjustment slot 162 and alternative adjustment hole 154.

Figure 6:
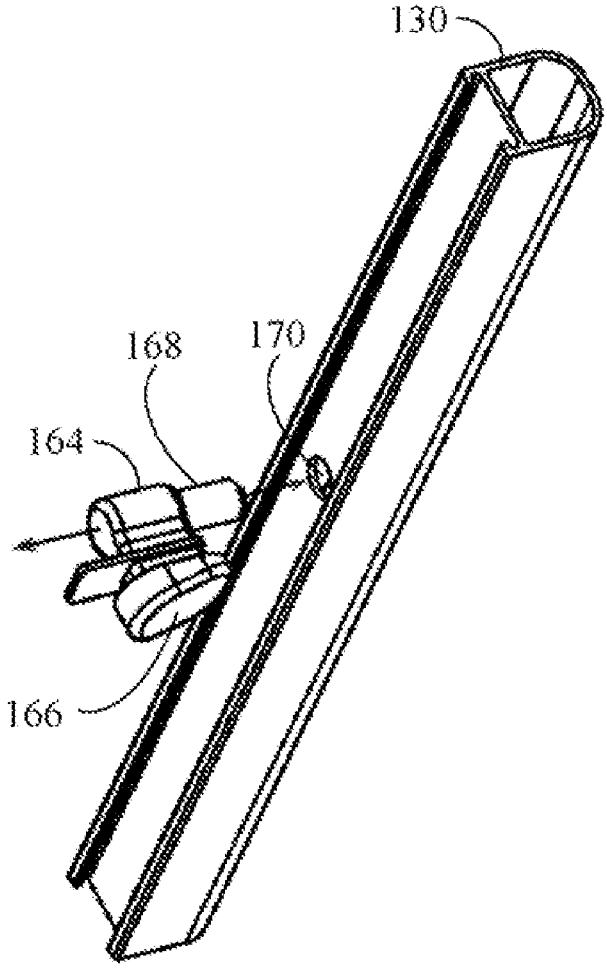
FIG. 6 is an illustration of a two slide clips that enable the crutch of FIGS. 1 and 2 to be secured in an expanded position for normal use.

FIG. 6 is a top-down view of wishbone 116 (FIGS. 1-3), including a slide clip 164 that enables wishbone 116 to be affixed in multiple positions with respect to rail 130 (FIGS. 1-3). Slide clip 164 is installed in wishbone strut 124 (FIGS. 1-3) of wishbone 116 with a second slide clip 172 (see FIGS. 7 and 8), both of which are illustrated in more detail below in conjunction with FIGS. 7 and 8. For the sake of simplicity, FIG. 6 does not show wishbone 116, first rail 128 or second slide clip 172, which is similar to slide clip 164 but is positioned within wishbone 116 on the side of first rail 128 (FIGS. 1-4).

Wishbone 116 may be moved along rail 130 when a user positions a slide clip button 166 in a direction away from rail 130, thus causing a slide clip pin 168 to be moved from a slide clip pinhole 170 in rail 130. When slide clip button 166 is positioned in a direction towards rail 130, or extended, slide clip pin 168 extends through slide clip pinhole 160 in rail 130 and prevents wishbone 116 from moving with respect to rail 130. Although shown with only one pinhole 170, rail 130 may have multiple pinholes so that wishbone 116 may be affixed in a number of different positions.

Figure 7:
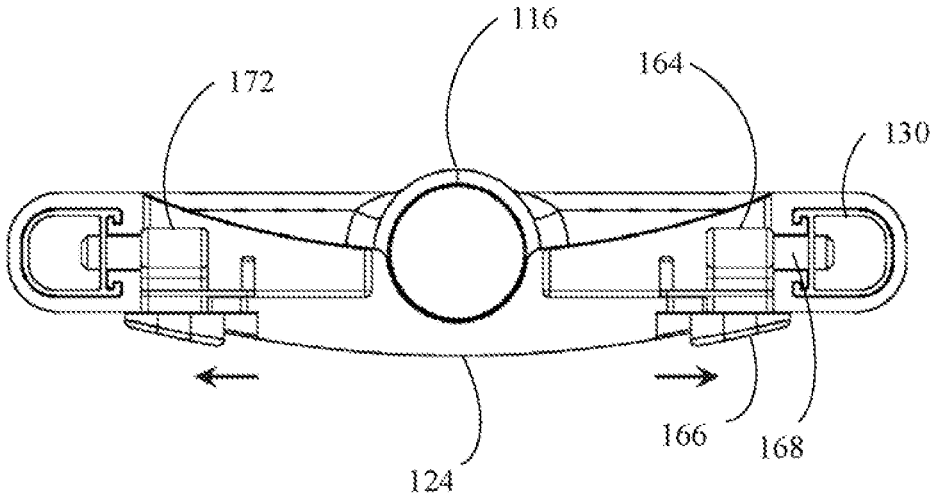
FIG. 7 is a cut-away illustration a wishbone support structure, including the slide clip of FIG. 6, when the crutch of FIGS. 1 and 2 is in an extended position.

FIG. 7 is a top-down view of wishbone 116 (FIGS. 1-3), including slide clip 164 of FIG. 6 in an extended position, i.e. securing wishbone 116 with respect to rail 130. FIG. 7 illustrates both slide clip 164 and slid clip 172 installed within wishbone strut 124 (FIGS. 1-3) of wishbone 116. In this illustration, slide clip button 166 is positioned towards rail 130 so that slide clip pin 168 extends through slide clip pinhole 170 in rail 130. It should be understood that slide clip 172 is configured and functions in a similar fashion as slide clip 164 to secure wishbone 116 with respect to rail 128.

Figure 8:
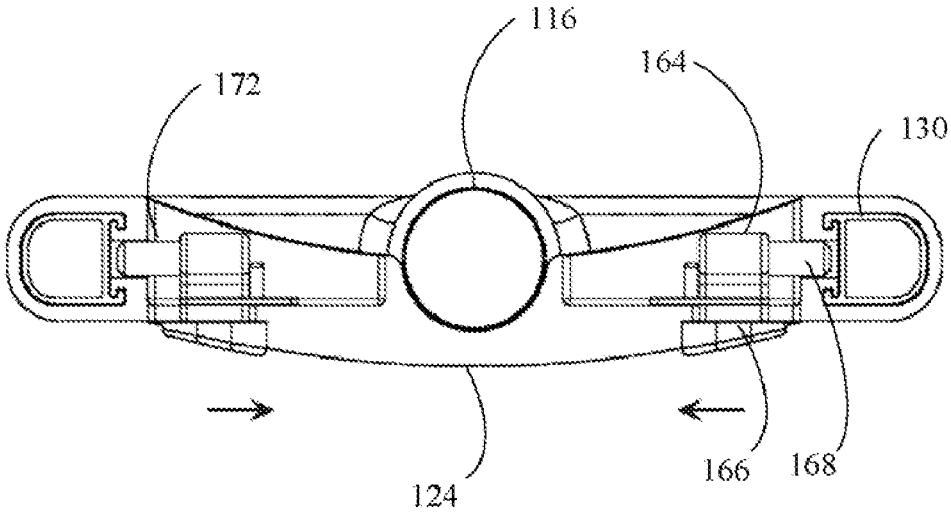
FIG. 8 is a cut-away illustration the wishbone, including of the slide clip of FIGS. 6 and 7, when the crutch of FIGS. 1 and 2 is in a retracted position.

FIG. 8 is an illustration of slide clip 164 of FIGS. 6 and 7 in a retracted position, i.e. a position that enables wishbone 116 (FIGS. 1-4) to be moved with respect to rail 130. Like FIG. 7, FIG. 8 illustrates both slide clip 164 and slide clip 172 installed within wishbone strut 124 (FIGS. 1-3) of wishbone 116. In this illustration, slide clip button 166 is positioned away from rail 130 so that slide clip pin 168 clears slide clip pinhole 170 in rail 130.

It should be understood that slide clips 164 and 172 are only one example of a mechanism for securing rails 128 and 130 with respect to wishbone 116. Those with skill in the mechanical arts should appreciate the many devices that may be employed to perform the same function. In addition, similar mechanisms (not shown), like those illustrated above to secure wishbone 116 to rails 128 and 130, are employed to secure handgrip 110 with respect to rails 128 and 130.

While the invention has been shown and described with reference to particular embodiments thereof, it will be understood by those skilled in the art that the foregoing and other changes in form and detail may be made therein without departing from the spirit and scope of the invention, including but not limited to additional, less or modified elements and/or additional, less or modified components.

I claim:

1. A multi-stage, collapsible orthopedic device, comprising a saddle support, wherein the saddle support is curved to tit comfortably under a user's underarm;

a plurality of rails attached to the saddle support;

a handgrip through which the plurality of rails pass, wherein the handgrip slides along plurality of rails and is able to be secured with respect to the plurality of rails;

a support tube, the support tube, comprising:

a shock tube;

a spring concealed within the shock tube and configured to cushion, from the wishbone, an impact of the shock tube against a surface; and an adjustment button that fits into a spring button hole in a spring compression plug and through a spring tube slide slot in the shock tube to provide a variable shock absorbing capability; and a wishbone, the wishbone comprising:

a plurality of upper channels, each upper channel corresponding to a rail of the plurality of rails, wherein the plurality of rails slide through their respective channels and may be secured with respect to the wishbone; and a lower channel, wherein the support tube slides through the lower channel and may be secured with respect to the wishbone in a plurality of positions.

2. The device of claim 1, further comprising an axillary cushion attached to the saddle support.

3. The device of claim 2, wherein the axillary cushion is color-coded to represent different possible sizes of the device.

4. The device of claim 1, the support tube comprising a plurality of markings, each marking indicating a configured length of the device corresponding to a specific position of the plurality of positions associated with the support tube and the wishbone.

5. The device of claim 1, wherein the handgrip may be secured to the rails in a plurality of positions.

6. The device of claim 1, wherein the device is configurable into a storage position and a nominal use position.

7. A multi-stage, collapsible crutch, comprising:

an axillary support structure, wherein the axillary support structure is curved to fit comfortably under a user's underarm;

two rails attached to the axillary support structure;

a handgrip through which the two rails pass, wherein the handgrip slides along the two rails and is able to be secured with respect to the two rails;

a support tube, the support tube, comprising:

a shock tube;

a spring concealed within the shock tube and configured to cushion, from the wishbone, an impact of the shock tube against a surface; and an adjustment button that fits into a spring button hole in a spring compression plug and through a spring tube slide slot in the shock tube to provide a variable shock absorbing capability; and a wishbone, the wishbone comprising:

two upper channels, each upper channel corresponding to a rail of the two rails, wherein the wishbone slides along the two rails and may be secured with respect to the two rails; and a lower channel, wherein the support tube slides along the lower channel and may be secured with respect to the wishbone in a plurality of positions.

8. The crutch of claim 7, further comprising an axillary cushion attached to the axillary support structure.

9. The device of claim 8, wherein the axillary cushion is color-coded to represent different possible sizes of the crutch.

10. The crutch of claim 7, the support tube comprising a plurality of markings, each marking indicating a configured length of the crutch corresponding to a specific position of the plurality of positions associated with the support tube and the wishbone.

11. The crutch of claim 7, wherein the handgrip may be secured to the rails in a plurality of positions.

12. The crutch of claim 7, wherein the crutch is configurable into a storage position and a nominal use position.

13. A multi-stage, collapsible orthopedic device, configurable into a storage configuration and a nominal use configuration, comprising:

a saddle support structure, wherein the saddle support structure is curved to fit comfortably under a user's underarm;

a plurality of rails attached to the saddle support structure;

a handgrip through which the plurality of rails pass, wherein the handgrip slides along plurality of rails and is able to be secured with respect to the plurality of rails;

a support tube, the support tube, comprising:

a shock tube;

a spring concealed within the shock tube and configured to cushion, from the wishbone, an impact of the shock tube against a surface; and an adjustment button that fits into a spring button hole in a spring compression plug and through a spring tube slide slot in the shock tube to provide a variable shock absorbing capability; and a wishbone, the wishbone comprising:

a plurality of upper channels, each upper channel corresponding to a rail of the plurality of rails, wherein the plurality of rails slide through their respective channels and may be secured with respect to the wishbone; and a lower channel, wherein the support tube slides through the lower channel and may be secured with respect to the wishbone in a plurality of positions;

wherein the device is in the storage configuration when the handgrip abuts the saddle support, the wishbone abuts the handgrip and the support tube is positioned as close as possible to the saddle support.

14. The device of claim 13, further comprising an axillary cushion attached to the saddle support structure.

15. The device of claim 14, wherein the axillary cushion is color-coded to represent different possible sizes of the device.

16. The device of claim 13, the support tube comprising a plurality of markings, each marking indicating a configured length of the device corresponding to a specific position of the plurality of positions associated with the support tube and the wishbone.

17. The device of claim 13, wherein the handgrip may be secured to the rails in a plurality of positions.

* * * * *